US011313637B1

(12) United States Patent
Jen

(10) Patent No.: US 11,313,637 B1
(45) Date of Patent: Apr. 26, 2022

(54) DETACHABLE TRIGGER GUARD FOR FIREARMS

(71) Applicant: Strike Industries, Inc., Santa Ana, CA (US)

(72) Inventor: YiHuei Jen, Santa Ana, CA (US)

( * ) Notice: Subject to any disclaimer, the term of this patent is extended or adjusted under 35 U.S.C. 154(b) by 218 days.

(21) Appl. No.: 16/702,890

(22) Filed: Dec. 4, 2019

Related U.S. Application Data

(60) Provisional application No. 62/776,679, filed on Dec. 7, 2018.

(51) Int. Cl.
*F41A 19/11* (2006.01)
*F41C 27/00* (2006.01)
*F41A 3/66* (2006.01)

(52) U.S. Cl.
CPC ..... *F41A 19/11* (2013.01); *F41A 3/66* (2013.01); *F41C 27/00* (2013.01)

(58) Field of Classification Search
CPC .. F41A 19/11; F41A 19/15; F41A 3/66; F41C 27/00
USPC ..... 42/90, 106
See application file for complete search history.

(56) References Cited

U.S. PATENT DOCUMENTS 9,217,618 B1 * 12/2015 Miller, III ..... F41A 19/11
10,571,210 B2 * 2/2020 Amodio ..... F41A 19/11
11,022,393 B2 * 6/2021 Robinson ..... F41A 19/11
11,085,727 B2 * 8/2021 Jen ..... F41A 35/02
2011/0173859 A1 * 7/2011 Findlay ..... F41A 19/11 42/69.01
2015/0354912 A1 * 12/2015 Miller, III ..... F41A 19/11 42/90
2016/0084601 A1 * 3/2016 Alicea, Jr. ..... F41A 17/20 42/6
2019/0162498 A1 * 5/2019 Amodio ..... F41A 19/11
2020/0240740 A1 * 7/2020 Jen ..... F41A 35/02

* cited by examiner

*Primary Examiner* — Jonathan C Weber

(74) *Attorney, Agent, or Firm* — Han IP PLLC; Andy M. Han

(57) ABSTRACT

Various examples of a detachable trigger guard for firearms are described. The trigger guard as a monolithic piece has components including a main body, a first connection portion at a first distal end of the main body, and a second connection portion at a second distal end of the main body opposite the first distal end thereof. At least one of the first connection portion and the second connection portion of the detachable trigger guard is elastically deformable to allow the detachable trigger guard to be removably coupled to a receiver portion of the firearm below a trigger of the firearm with the first connection portion coupled to either or both of a first pair of through holes on the receiver portion of the firearm and with the second connection portion coupled to either or both of a second pair of through holes on the receiver portion of the firearm.

3 Claims, 3 Drawing Sheets

DETACHABLE TRIGGER GUARD FOR FIREARMS

CROSS REFERENCE TO RELATED PATENT APPLICATION(S)

The present disclosure is part of a non-provisional application claiming the priority benefit of U.S. Patent Application No. 62/776,679, filed 7 Dec. 2018, the content of which being incorporated herein in its entirety.

TECHNICAL FIELD

The present disclosure is generally related to firearms and, more particularly, to a detachable trigger guard for firearms.

BACKGROUND

Unless otherwise indicated herein, approaches described in this section are not prior art to the claims listed below and are not admitted as prior art by inclusion in this section.

On firearms such as rifles, carbines and pistols based on the AR-15 platform as well as other platforms, a number of accessories can be added and a number of components can be replaced for customization. One popular customization is removal or replacement of the trigger guard. In a firearm, a conventional detachable trigger guard is typically mounted on or otherwise coupled to a receiver portion of the firearm (e.g., lower receiver) below a trigger thereof with dowel pin(s), roll pin(s) and/or spring-loaded pin(s). However, a tool is usually required for the removal and/or installation of the conventional detachable trigger guard.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

An objective of the present disclosure is to provide innovative designs of a detachable trigger guard that can be mounted to and removed from a receiver portion (e.g., lower receiver) of a firearm (e.g., an AR-15 style firearm) with a simple tool to disassemble. Thus, a detachable trigger guard in accordance with the present disclosure may be considered an almost tool-free detachable trigger guard.

In one aspect, a device implementable on a firearm may include a detachable trigger guard as a monolithic piece having a plurality of components including a main body, a first connection portion at a first distal end of the main body, and a second connection portion at a second distal end of the main body opposite the first distal end thereof. At least one of the first connection portion and the second connection portion of the detachable trigger guard may be elastically deformable to allow the detachable trigger guard to be removably coupled to a receiver portion of the firearm below a trigger of the firearm by: (a) the first connection portion being coupled to either or both of a first pair of through holes on the receiver portion of the firearm, and (b) the second connection portion being coupled to either or both of a second pair of through holes on the receiver portion of the firearm.

In one aspect, a device implementable on a firearm may include a detachable trigger guard as a monolithic piece having a plurality of components including a main body, a first connection portion at a first distal end of the main body, and a second connection portion at a second distal end of the main body opposite the first distal end thereof. At least one of the first connection portion and the second connection portion of the detachable trigger guard may be elastically deformable to allow the detachable trigger guard to be removably coupled to a receiver portion of the firearm below a trigger of the firearm by: (a) the first connection portion being coupled to either or both of a first pair of through holes on the receiver portion of the firearm, and (b) the second connection portion being coupled to either or both of a second pair of through holes on the receiver portion of the firearm. The first connection portion may include at least one first protrusion configured to engage with and be partially received in a respective one of the first pair of through holes when the detachable trigger guard is coupled to the receiver portion of the firearm. The second connection portion may include at least one second protrusion configured to engage with and be partially received in a respective one of the second pair of through holes when the detachable trigger guard is coupled to the receiver portion of the firearm. The first connection portion may be separated from the main body by at least one first gap which, when the detachable trigger guard is coupled to the receiver portion of the firearm, extends in a direction along a longitudinal axis of the firearm. The second connection portion may be separated from the main body by at least one second gap which, when the detachable trigger guard is coupled to the receiver portion of the firearm, extends in a direction along the longitudinal axis of the firearm.

In one aspect, an apparatus may include a firearm and a detachable trigger guard. The firearm may include a receiver portion and a trigger coupled to and extending from the receiver portion. The detachable trigger guard may be a monolithic piece having a plurality of components including a cover plate, a first connection portion at a first distal end of the main body, and a second connection portion at a second distal end of the main body opposite the first distal end thereof. At least one of the first connection portion and the second connection portion of the detachable trigger guard may be elastically deformable to allow the detachable trigger guard to be removably coupled to the receiver portion of the firearm below the trigger of the firearm by: (a) the first connection portion being coupled to either or both of a first pair of through holes on the receiver portion of the firearm, and (b) the second connection portion being coupled to either or both of a second pair of through holes on the receiver portion of the firearm.

BRIEF DESCRIPTION OF THE DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

Overview

Figure 1:
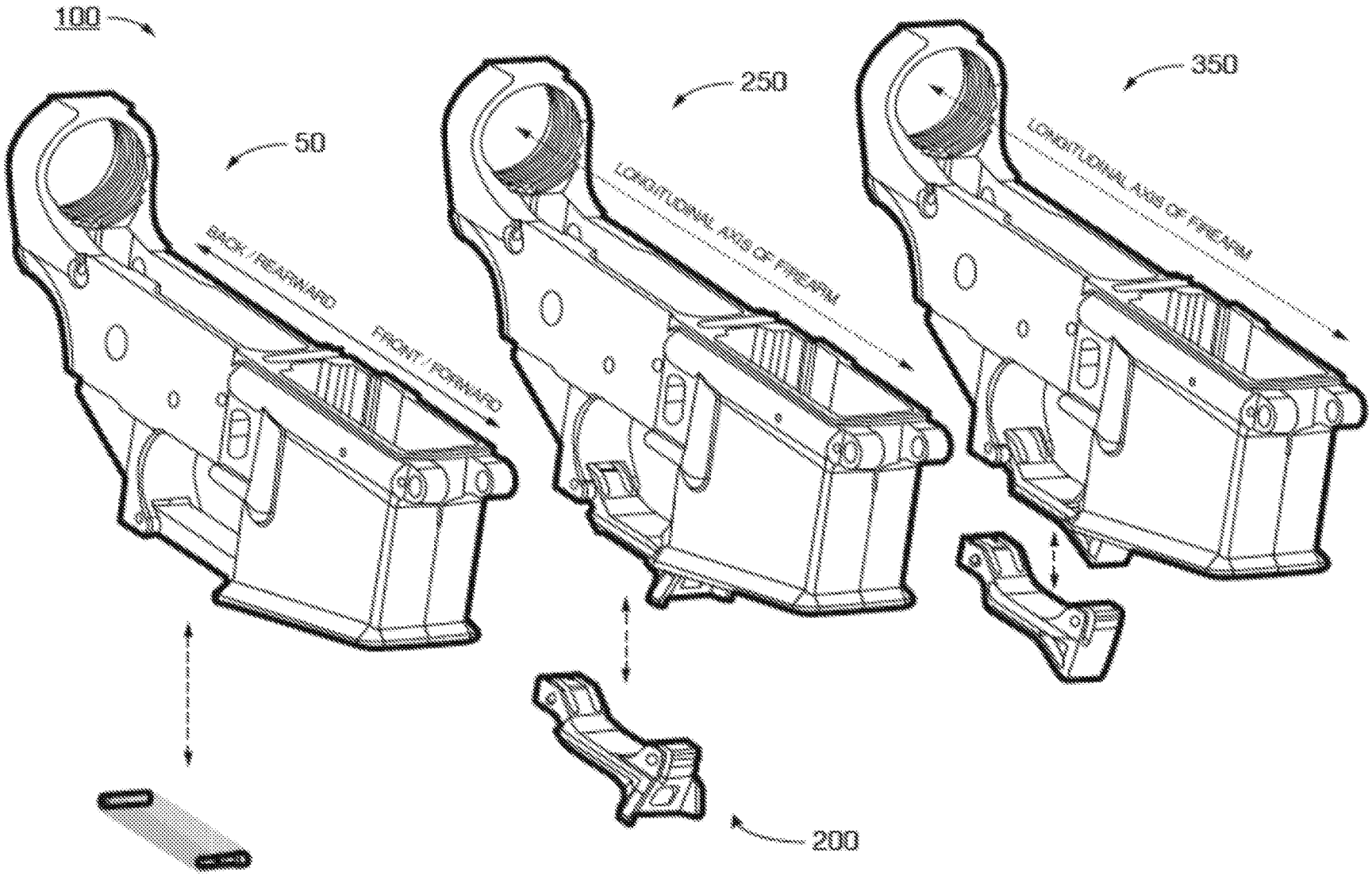
FIG. 1 is a diagram of a display of various designs in accordance with an implementation of the present disclosure.

FIG. 1 illustrates a display 100 of various designs in accordance with an implementation of the present disclosure. In display 100, a conventional detachable trigger guard 10 as well as a detachable trigger guard 200 and a detachable trigger guard 300 in accordance with the present disclosure are shown. Each of detachable trigger guard 10, 200 and 300 may be removably coupled to a receiver portion (e.g., lower receiver) of a firearm (e.g., AR-15 style firearm). In the example shown in FIG. 1, detachable trigger guard 10 may be removably coupled to a receiver portion 50, detachable trigger guard 200 may be removably coupled to a receiver portion 250, and detachable trigger guard 300 may be removably coupled to a receiver portion 350. When removably coupled to the respective receiver portion of the firearm, each of detachable trigger guards 200 and 300 may, together with the receiver portion, partially surround a trigger of the firearm.

Illustrative Implementations

Figure 2:
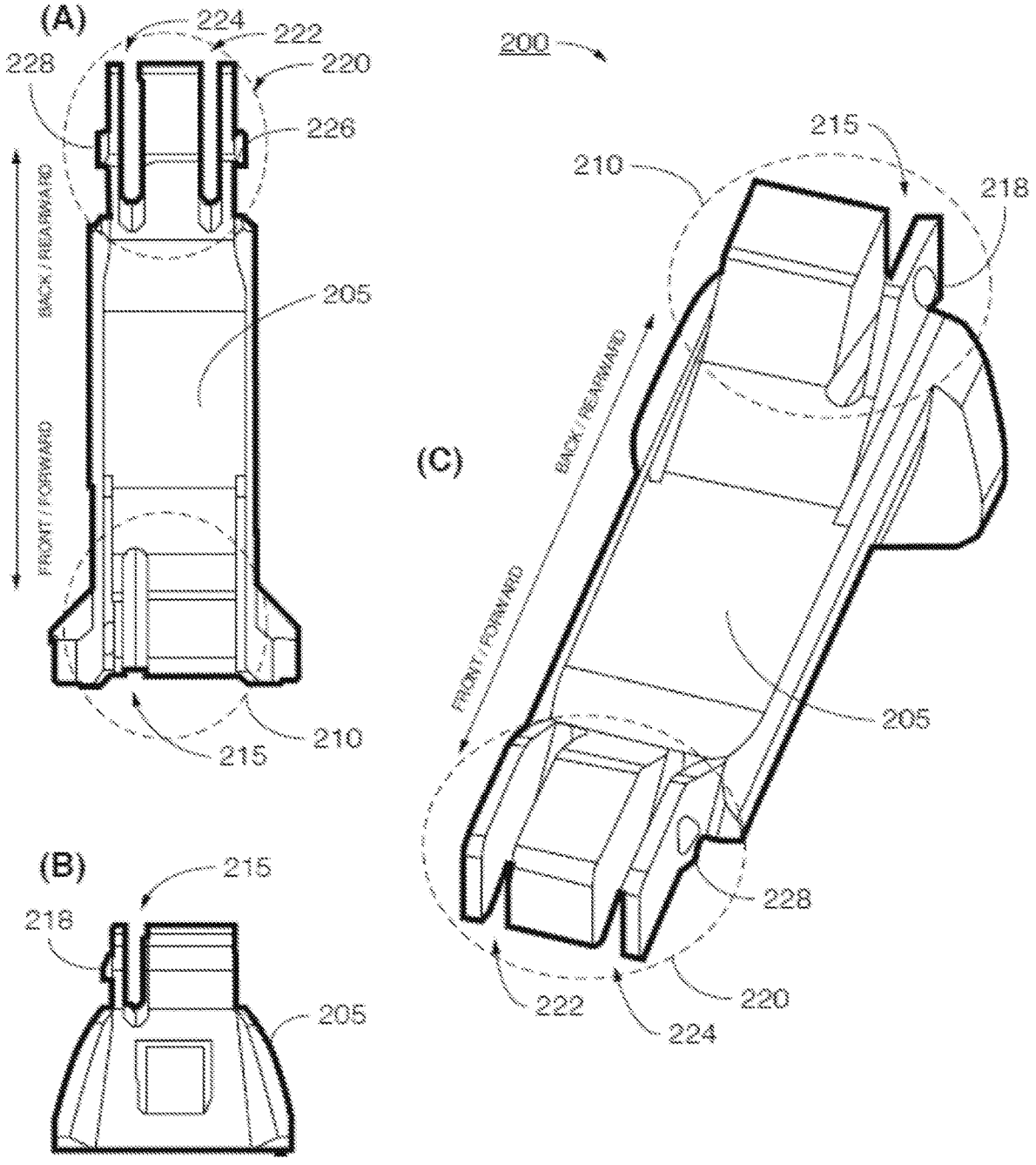
FIG. 2 is a diagram of a detachable trigger guard in accordance with an implementation of the present disclosure.

FIG. 2 illustrates detachable trigger guard 200 in accordance with an implementation of the present disclosure. Part (A) of FIG. 2 shows a top view of detachable trigger guard 200. Part (B) of FIG. 2 shows a front view of detachable trigger guard 200. Part (C) of FIG. 2 shows a perspective view of detachable trigger guard 200. Detachable trigger guard 200 may be a monolithic piece having a plurality of components including a main body 205, a first connection portion 210 at a first distal end (e.g., front) of main body 205 and a second connection portion 220 at a second distal end (e.g., back) of main body 205 opposite the first distal end thereof. At least one of the first connection portion 210 and the second connection portion 220 of detachable trigger guard 200 may be elastically deformable to allow detachable trigger guard 200 to be removably coupled to receiver portion 250 (e.g., lower receiver) of a firearm below a trigger of the firearm. When detachable trigger guard 200 is installed/mounted on or otherwise coupled to the receiver portion, the first connection portion 210 may be coupled to either or both of a first pair of through holes on receiver portion 250, and the second connection portion 220 may be coupled to either or both of a second pair of through holes on receiver portion 250.

Referring to FIG. 2, the first connection portion 210 may include at least one first protrusion 218 configured to engage with and be partially received in a respective one of the first pair of through holes when detachable trigger guard 200 is coupled to receiver portion 250. In some implementations, the at least one first protrusion 218 may extend from a first sidewall of the first connection portion 210. When detachable trigger guard 200 is coupled to receiver portion 250, an outer surface of the first sidewall may be directly in contact with receiver portion 250 such that the at least one first protrusion 218 may be aligned with the respective one of the first pair of through holes. Moreover, the at least one first protrusion 218 may have a slanted surface at an angle between 0° and 90° relative to the outer surface of the first sidewall. In some implementations, the first sidewall may be separated from main body 205 by at least one first gap 215 which, when detachable trigger guard 200 is coupled to receiver portion 250, may extend in a direction along a longitudinal axis of the firearm.

Referring to FIG. 2, the second connection portion 220 may include second protrusions 226 and 228 each configured to engage with and be partially received in a respective one of the second pair of through holes when detachable trigger guard 200 is coupled to receiver portion 250. In some implementations, at least one of second protrusions 226 and 228 may extend from a second sidewall of the second connection portion 220. When detachable trigger guard 200 is coupled to receiver portion 250, an outer surface of the second sidewall may be directly in contact with receiver portion 250 such that the at least one of second protrusions 226 and 228 may be aligned with the respective one of the second pair of through holes. Furthermore, the at least one of second protrusions 226 and 228 may have a slanted surface at an angle between 0° and 90° relative to the outer surface of the second sidewall. In some implementations, the second sidewall may be separated from main body 205 by at least one second gap 222 or 224 which, when detachable trigger guard 200 is coupled to receiver portion 250, may extend in a direction along the longitudinal axis of the firearm.

In some implementations, detachable trigger guard 200 may be made of polymer. Alternatively, detachable trigger guard 200 may be made of metal.

As each of the first connection portion 210 and the second connection portion 220 is elastically deformable and is an integral part of the monolithic piece of detachable trigger guard 200, there is no need of external components, such as a plunger and spring, as in conventional designs. Advantageously, this can save both the cost and time in manufacturing.

Figure 3:
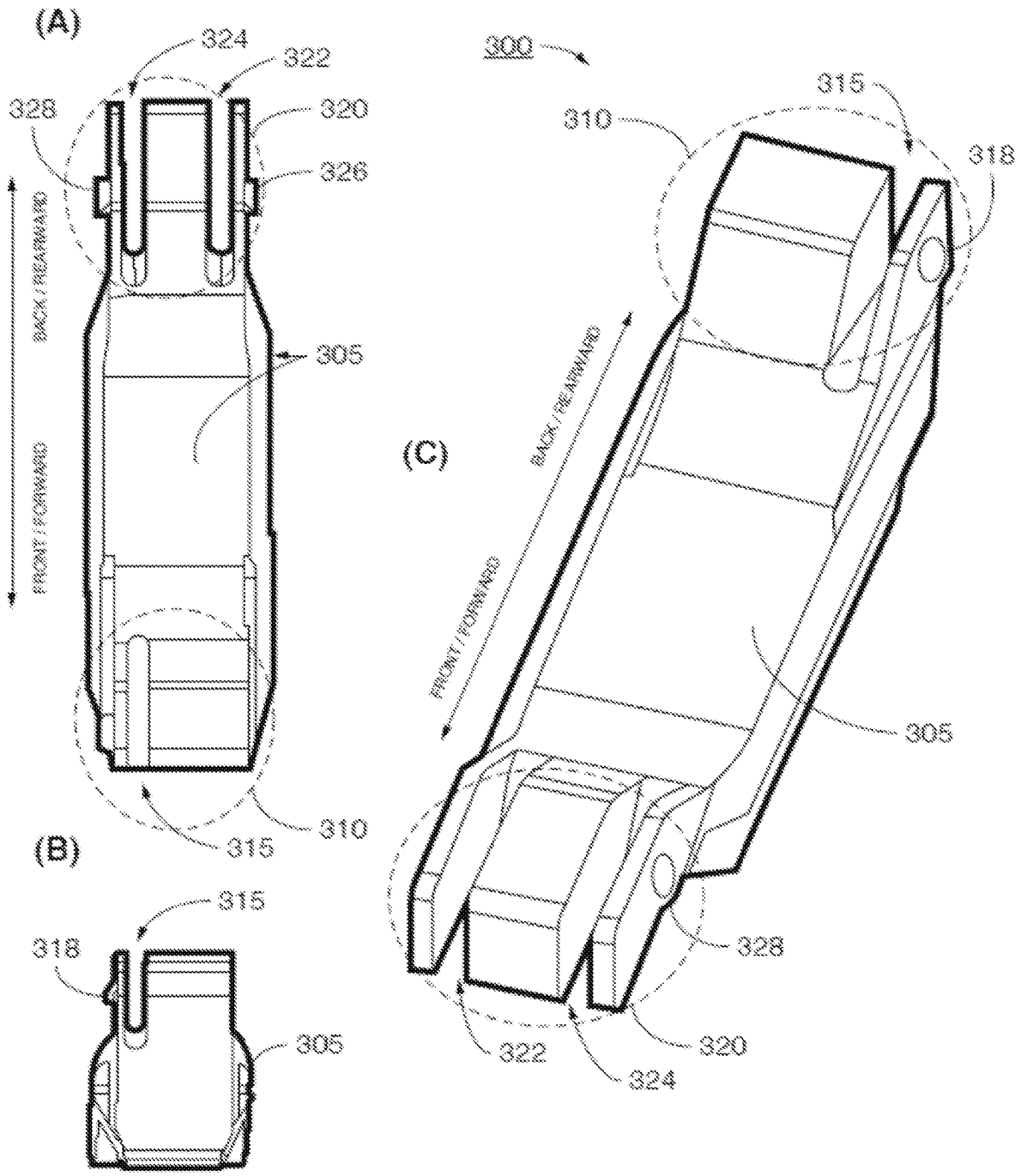
FIG. 3 is a diagram of a detachable trigger guard in accordance with an implementation of the present disclosure.

FIG. 3 illustrates detachable trigger guard 300 in accordance with an implementation of the present disclosure. Part (A) of FIG. 3 shows a top view of detachable trigger guard 300. Part (B) of FIG. 3 shows a front view of detachable trigger guard 300. Part (C) of FIG. 3 shows a perspective view of detachable trigger guard 300. Detachable trigger guard 300 may be a monolithic piece having a plurality of components including a main body 305, a first connection portion 310 at a first distal end (e.g., front) of main body 305 and a second connection portion 320 at a second distal end (e.g., back) of main body 305 opposite the first distal end thereof. At least one of the first connection portion 310 and the second connection portion 320 of detachable trigger guard 300 may be elastically deformable to allow detachable trigger guard 300 to be removably coupled to receiver portion 350 (e.g., lower receiver) of a firearm below a trigger of the firearm. When detachable trigger guard 300 is installed/mounted on or otherwise coupled to the receiver portion, the first connection portion 310 may be coupled to either or both of a first pair of through holes on receiver portion 350, and the second connection portion 320 may be coupled to either or both of a second pair of through holes on receiver portion 350.

Referring to FIG. 3, the first connection portion 310 may include at least one first protrusion 318 configured to engage with and be partially received in a respective one of the first pair of through holes when detachable trigger guard 300 is coupled to receiver portion 350. In some implementations, the at least one first protrusion 318 may extend from a first sidewall of the first connection portion 310. When detachable trigger guard 300 is coupled to receiver portion 350, an outer surface of the first sidewall may be directly in contact with receiver portion 350 such that the at least one first protrusion 318 may be aligned with the respective one of the first pair of through holes. Moreover, the at least one first protrusion 318 may have a slanted surface at an angle between 0° and 90° relative to the outer surface of the first sidewall. In some implementations, the first sidewall may be separated from main body 305 by at least one first gap 315 which, when detachable trigger guard 300 is coupled to receiver portion 350, may extend in a direction along a longitudinal axis of the firearm.

Referring to FIG. 3, the second connection portion 320 may include second protrusions 326 and 328 each configured to engage with and be partially received in a respective one of the second pair of through holes when detachable trigger guard 300 is coupled to receiver portion 350. In some implementations, at least one of second protrusions 326 and 328 may extend from a second sidewall of the second connection portion 320. When detachable trigger guard 300 is coupled to receiver portion 350, an outer surface of the second sidewall may be directly in contact with receiver portion 350 such that the at least one of second protrusions 326 and 328 may be aligned with the respective one of the second pair of through holes. Furthermore, the at least one of second protrusions 326 and 328 may have a slanted surface at an angle between 0° and 90° relative to the outer surface of the second sidewall. In some implementations, the second sidewall may be separated from main body 305 by at least one second gap 322 or 324 which, when detachable trigger guard 300 is coupled to receiver portion 350, may extend in a direction along the longitudinal axis of the firearm.

In some implementations, detachable trigger guard 300 may be made of polymer. Alternatively, detachable trigger guard 300 may be made of metal.

As each of the first connection portion 310 and the second connection portion 320 is elastically deformable and is an integral part of the monolithic piece of detachable trigger guard 300, there is no need of external components, such as a plunger and spring, as in conventional designs. Advantageously, this can save both the cost and time in manufacturing.

Feature Highlight

In view of the above, select features of various implementations in accordance with the present disclosure are highlighted below.

In one aspect, a device implementable on a firearm may include a detachable trigger guard as a monolithic piece having a plurality of components including a main body, a first connection portion at a first distal end of the main body, and a second connection portion at a second distal end of the main body opposite the first distal end thereof. At least one of the first connection portion and the second connection portion of the detachable trigger guard may be elastically deformable to allow the detachable trigger guard to be removably coupled to a receiver portion of the firearm below a trigger of the firearm by: (a) the first connection portion being coupled to either or both of a first pair of through holes on the receiver portion of the firearm, and (b) the second connection portion being coupled to either or both of a second pair of through holes on the receiver portion of the firearm.

In some implementations, the first connection portion may include at least one first protrusion configured to engage with and be partially received in a respective one of the first pair of through holes when the detachable trigger guard is coupled to the receiver portion of the firearm.

In some implementations, the at least one first protrusion may extend from a first sidewall of the first connection portion. When the detachable trigger guard is coupled to the receiver portion, an outer surface of the first sidewall may be directly in contact with the receiver portion such that the at least one first protrusion is aligned with the respective one of the first pair of through holes. The at least one first protrusion may have a slanted surface at an angle between 0° and 90° relative to the outer surface of the first sidewall.

In some implementations, the first sidewall may be separated from the main body by at least one first gap which, when the detachable trigger guard is coupled to the receiver portion of the firearm, extends in a direction along a longitudinal axis of the firearm.

In some implementations, the second connection portion may include at least one second protrusion configured to engage with and be partially received in a respective one of the second pair of through holes when the detachable trigger guard is coupled to the receiver portion of the firearm.

In some implementations, the at least one second protrusion may extend from a second sidewall of the second connection portion. When the detachable trigger guard is coupled to the receiver portion, an outer surface of the second sidewall may be directly in contact with the receiver portion such that the at least one second protrusion is aligned with the respective one of the second pair of through holes. The at least one second protrusion may have a slanted surface at an angle between 0° and 90° relative to the outer surface of the second sidewall.

In some implementations, the second sidewall may be separated from the main body by at least one second gap which, when the detachable trigger guard is coupled to the receiver portion of the firearm, extends in a direction along a longitudinal axis of the firearm.

In some implementations, the detachable trigger guard may be made of polymer.

In some implementations, the detachable trigger guard may be made of metal.

In one aspect, a device implementable on a firearm may include a detachable trigger guard as a monolithic piece having a plurality of components including a main body, a first connection portion at a first distal end of the main body, and a second connection portion at a second distal end of the main body opposite the first distal end thereof. At least one of the first connection portion and the second connection portion of the detachable trigger guard may be elastically deformable to allow the detachable trigger guard to be removably coupled to a receiver portion of the firearm below a trigger of the firearm by: (a) the first connection portion being coupled to either or both of a first pair of through holes on the receiver portion of the firearm, and (b) the second connection portion being coupled to either or both of a second pair of through holes on the receiver portion of the firearm. The first connection portion may include at least one first protrusion configured to engage with and be partially received in a respective one of the first pair of through holes when the detachable trigger guard is coupled to the receiver portion of the firearm. The second connection portion may include at least one second protrusion configured to engage with and be partially received in a respective one of the second pair of through holes when the detachable trigger guard is coupled to the receiver portion of the firearm. The first connection portion may be separated from the main body by at least one first gap which, when the detachable trigger guard is coupled to the receiver portion of the firearm, extends in a direction along a longitudinal axis of the firearm. The second connection portion may be separated from the main body by at least one second gap which, when the detachable trigger guard is coupled to the receiver portion of the firearm, extends in a direction along the longitudinal axis of the firearm.

In one aspect, an apparatus may include a firearm and a detachable trigger guard. The firearm may include a receiver portion and a trigger coupled to and extending from the receiver portion. The detachable trigger guard may be a monolithic piece having a plurality of components including a cover plate, a first connection portion at a first distal end of the main body, and a second connection portion at a second distal end of the main body opposite the first distal end thereof. At least one of the first connection portion and the second connection portion of the detachable trigger guard may be elastically deformable to allow the detachable trigger guard to be removably coupled to the receiver portion of the firearm below the trigger of the firearm by: (a) the first connection portion being coupled to either or both of a first pair of through holes on the receiver portion of the firearm, and (b) the second connection portion being coupled to either or both of a second pair of through holes on the receiver portion of the firearm.

In some implementations, the first connection portion may include at least one first protrusion configured to engage with and be partially received in a respective one of the first pair of through holes when the detachable trigger guard is coupled to the receiver portion of the firearm.

In some implementations, the at least one first protrusion may extend from a first sidewall of the first connection portion. When the detachable trigger guard is coupled to the receiver portion, an outer surface of the first sidewall may be directly in contact with the receiver portion such that the at least one first protrusion is aligned with the respective one of the first pair of through holes. The at least one first protrusion may have a slanted surface at an angle between 0° and 90° relative to the outer surface of the first sidewall.

In some implementations, the first sidewall may be separated from the main body by at least one first gap which, when the detachable trigger guard is coupled to the receiver portion of the firearm, extends in a direction along a longitudinal axis of the firearm.

In some implementations, the second connection portion may include at least one second protrusion configured to engage with and be partially received in a respective one of the second pair of through holes when the detachable trigger guard is coupled to the receiver portion of the firearm.

In some implementations, the at least one second protrusion may extend from a second sidewall of the second connection portion. When the detachable trigger guard is coupled to the receiver portion, an outer surface of the second sidewall may be directly in contact with the receiver portion such that the at least one second protrusion is aligned with the respective one of the second pair of through holes. The at least one second protrusion may have a slanted surface at an angle between 0° and 90° relative to the outer surface of the second sidewall.

In some implementations, the second sidewall may be separated from the main body by at least one second gap which, when the detachable trigger guard is coupled to the receiver portion of the firearm, extends in a direction along a longitudinal axis of the firearm.

In some implementations, the detachable trigger guard may be made of polymer.

In some implementations, the detachable trigger guard may be made of metal.

In some implementations, the firearm may include a rifle, carbine or pistol based on an AR-15 platform or another platform on which a trigger thereof can be guarded.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a detachable trigger guard as a monolithic piece having a plurality of components comprising:

a main body;

a first connection portion at a first distal end of the main body; and a second connection portion at a second distal end of the main body opposite the first distal end thereof, wherein both of the first connection portion and the second connection portion of the detachable trigger guard are elastically deformable to allow the detachable trigger guard to be removably coupled to a receiver portion of the firearm below a trigger of the firearm by:

the first connection portion being coupled to either or both of a first pair of through holes on the receiver portion of the firearm, and the second connection portion being coupled to either or both of a second pair of through holes on the receiver portion of the firearm, wherein the first connection portion comprises a first protrusion configured to engage with and be partially received in a respective one of the first pair of through holes when the detachable trigger guard is coupled to the receiver portion of the firearm, wherein the first protrusion is on a sidewall separated from the main body by a first gap which, when the detachable trigger guard is coupled to the receiver portion of the firearm, extends in a direction along a longitudinal axis of the firearm, wherein the second connection portion comprises two second protrusions each configured to engage with and be partially received in a respective one of the second pair of through holes when the detachable trigger guard is coupled to the receiver portion of the firearm, with one of the two second protrusions on a first sidewall of the second connection portion and another of the two second protrusions on a second sidewall of the second connection portion opposite the first sidewall when the detachable trigger guard is coupled to the receiver portion of the firearm, and wherein each of the first sidewall and the second sidewall of the second connection portion is separated from the main body by a respective second gap of two second gaps which, when the detachable trigger guard is coupled to the receiver portion of the firearm, extends in a direction along the longitudinal axis of the firearm.

2. The device of claim 1, wherein the detachable trigger guard is made of polymer.

3. The device of claim 1, wherein the detachable trigger guard is made of metal.

* * * * *